United States Patent [19]

Schellenberg et al.

[11] 3,957,516

[45] May 18, 1976

[54] PREPARATION FOR THE PROCESSING OF PHOTOGRAPHIC MATERIALS

[75] Inventors: Matthias Schellenberg; Christoph Chylewski, both of Marly; Max Meier, Fribourg, all of Switzerland

[73] Assignee: Ciba-Geigy AG, Basel, Switzerland

[22] Filed: May 10, 1974

[21] Appl. No.: 468,837

[30] Foreign Application Priority Data

May 17, 1973 Switzerland ..... 7061/73

[52] U.S. Cl. ..... 96/53; 96/66.4

[51] Int. Cl.[2] ..... G03C 7/00

[58] Field of Search ..... 96/53, 20

[56] References Cited

UNITED STATES PATENTS

| | | | |
|---|---|---|---|
| 3,278,303 | 10/1966 | Meyer et al. | 96/53 |
| 3,455,690 | 7/1969 | Schaefer et al. | 96/53 |
| 3,457,074 | 7/1969 | Wilson et al. | 96/20 |
| 3,615,494 | 10/1971 | Watanabe et al. | 96/53 |
| 3,782,948 | 1/1974 | Froehlich et al. | 96/53 |

*Primary Examiner*—J. Travis Brown

*Attorney, Agent, or Firm*—Joseph G. Kolodny; Edward McC. Roberts; Prabodh Almaula

[57] ABSTRACT

The present invention relates to an oil-in-water emulsion which is suitable for processing photographic material. There is present or produced during the processing a substance which exerts its action on the photographic material from the aqueous phase. Contingent on the consumption the active substance is replenished or regenerated from the oily phase. The active substance is more readily soluble in the oily phase than in the aqueous one. The active substance may be, e.g., a dye bleach catalyst for silver dye bleach material or an alkylmercaptan, the latter acting as an antioxidant.

2 Claims, No Drawings

PREPARATION FOR THE PROCESSING OF PHOTOGRAPHIC MATERIALS

In baths for the processing of photographic materials it is often necessary to keep certain constituents within specific levels of concentration. This involves on occasion a continuous, careful inspection of the baths for their content of active substance and an appropriate replacement of substances used up. Other baths contain relatively unstable substances, e.g., silver developers, which decompose even if the bath is not used, especially through air oxidation. It is the object of the present invention, inter alia, to eliminate these disadvantages, i.e., to facilitate the maintenance of a prescribed bath concentration and to impart good stability to the baths. This is made possible by utilising partition equilibria in two-phase systems.

The invention accordingly provides a preparation suitable for the processing of photographic materials. The preparation consists of an oil-in-water emulsion wherein there is present or produced a substance which exerts its action on the photographic material from the aqueous phase and, contingent on the consumption, is replenished from the oily phase, with the active substance being more readily soluble in the oily phase than in the aqueous one.

The oily phase consequently contains a stock of active substance which is continuously delivered to the aqueous phase at the same rate as active substance has therein been used up. It is therefore expedient if the active substance is more readily soluble, advantageously at least 10 times more so, in the oily phase than in the aqueous phase. The quantitative ratio of oily phase to aqueous phase can vary within wide limits; advantageously it is in the range 1:10 to 1:100 (by volume).

Attention has been drawn already to the possibility of using preparations of this kind with developer substances. In general, it is possible to manufacture preparations whose aqueous phase has a composition which is able to effect a chemical reducing process which proceeds either as a function of a latent silver image, or, e.g., in the silver dyebleach process, as a function of a developed silver image of the photographic material. Thus, the aqueous phase, for example, can contain an active substance for the processing of the photographic material and the oily phase a regenerator for the active substance.

A particularly advantageous embodiment of this kind consists in a suitable dye bleach bath for silver dye bleach material, i.e., a preparation which, in addition to the other requisite substances for a silver dye bleach bath, contains a dye bleach catalyst. Silver dye bleach positive print materials without double layer structure ordinarily require — it the gradation may not become very steep — a small concentration of the catalyst in the dye bleach bath. However, this requirement is at variance with the greatest possible stability of the dye bleach bath simultaneously desired, for bath constituents added in very small amounts easily lead to fluctuations. For this reason efforts have also been made to find a kind of buffering possibility for dye bleach catalysts.

By dissolving a lipophilic bleach catalyst in an oily liquid and emulsifying this oily phase in an aqueous dye bleach bath, a small concentration of catalyst corresponding to the partition equilibrium is established in the aqueous phase. If the concentration in the aqueous phase changes, the partition equilibrium readjusts at once, i.e., the concentration of catalyst in the aqueous phase is kept virtually constant.

A number of dye bleach catalysts which are sufficiently lipophilic and which conform to the requirements of practice in respect of solubility in water and solubility in the dye bleach baths are known. Such catalysts are to be found among those described in the following publications:

U.S. Pat. Nos. 2,270,118 (Re 22308 2,183,395 2,669,517 and 2,627,461; Swiss Pat. Nos. 433,980, 439,963, 440,968 and 450,163; German Offenlegungschriften Nos. 2,010,280, 2,144,298 and 2,144,297.

Very suitable catalyst are also those which are more readily soluble in the oily phase than in the aqueous phase of the dye bleach bath. As examples of such catalysts there may be cited the compounds of the formulae:

(1)

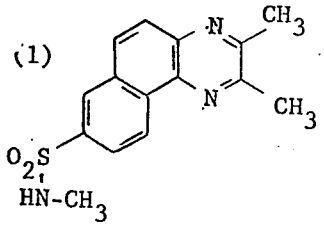

and (2)

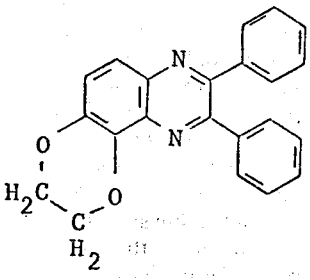

It is evident from the above particulars that the dye bleach baths according to the invention should for practical reasons contain a substantially greater amount of dye bleach catalyst (present principally in the oily phase) than the known dye bleach baths consisting only of an aqueous phase customarily do.

Suitable organic solvents for the oily phase of the dye bleach bath are, e.g., paraffin oil, phthalic acid dibutyl ester, and, in particular, phosphoric acid tricresyl ester. The solvents which form the oily phase should be so chosen that they are inert towards the other substances always present in the dye bleach bath and that they can be processed to fine and stable emulsions using an emulsifier. As further examples of solvents there may be mentioned: adipic acid dioctyl ester, castor oil, ricinic acid ester, phosphoric acid tributyl ester, phthalic acid dioctyl ester, sebacic acid dibutyl ester, chloroparaffins (40 to 50% chlorine content).

For the rest, the dye bleach baths can have the customary known compositions, e.g., they can contain an alkali bromide or iodide or thiorurea and optionally an antioxidant, e.g., sodium hypophosphite, and, to attain the necessary pH value. A strong organic or inorganic acid, such as benzenesulphonic acid, hydrochloric acid, sulphuric acid, sulphamic acid or sodium hydrogen sulphate. As oil-in-water emulsions, the dye bleach baths can be readily diluted with water and, after termination of the dye bleaching, can be easily and completely rinsed off from the photographic material with water.

If the preparation according to the invention contains a developer substance as active substance, then it is advantageous to use an oily phase which is itself an antioxidant that is sparingly soluble in water or which contains such an antioxidant. As antioxidants it is possible to use known ones, e.g., olefins such as tetraphenylethylene, phenols, such as 2,6-dibutyl-4-methylphenol, amines, such as 1,4-di-sec.butylamino-benzene.

A particularly valuable embodiment of the present invention consists of "lith developers," and another of chromogenic colour developers.

It is common knowledge that lith developers are used for developing halftone images whereby sharply defined picture points must be formed. The photographic materials used for this purpose ordinarily contain silver halides with a large proportion of silver chloride. The object can be achieved even with very simple developers which contain, e.g., hydroquinone, a carbonate as buffer, a small amount of bromide and a small amount of sulphite. But these developers are so susceptible to oxidation that they can only be prepared with water made airfree by boiling and used under nitrogen. It would appear that the sulphite has a dual function: on the one hand it controls in some way the infections development on which the lith effect is based, and on the other, it protects the developer from oxidation by atmospheric oxygen. For the first purpose, however, much smaller concentrations of sulphite are required than for the second. The lith developers used in the trade contain formaldehyde-bisulphite as sulphite buffer, whereby their durability is prolonged. But even then they leave much to be desired and a great deal of effort is being expended at present on the development of more stable systems. Moreover, such developers also decompose in the absence of oxygen by condensation of the formaldehyde with the hydroquinone.

It is possible to avoid these disadvantages by an appropriate application of the present invention by adding to the developer an antioxidant, the developer being in the form of an oil-in-water emulsion which contains in the aqueous phase the customary substances (see above) of a lith film developer and in the oily phase, or as oily phase, an antioxidant. Suitable antioxidants are in this connection in particular higher alkylmercaptans (with at least 10 carbon atoms) which do not congeal in the oily phase at operating temperature. A particularly suitable antioxidant is n-dodecylmercaptan, which as oily phase requires no solvent or diluent.

However, these developers should not contain any formaldehyde or any formaldehyde donors, since such compounds react with mercaptans. It is possible to add water-soluble antioxidants, but in general the development time is thereby prolonged.

The mercaptan-containing lith developers according to the present invention are stable in air for much longer than the corresponding developers without mercaptan. Upon standing, a thin, wax-like layer forms on the surface in a few hours. This layer does not stick, does not hinder the immersion of the photographic material, but promotes the antioxidation as interface vis-a-vis the atmosphereic oxygen and also retards the evaporation of water. If the formation of such a surface layer is not desired, then it can be very largely inhibited, or at least retarded, by appropriate measures, such as the addition of phosphoric acid tricresyl ester.

Like lith developers, chromogenic colour developers also contain only a small amount of sulphite, since this ion, in competition with the coupler anion, reacts with oxidized developer substance and can therefore have an unfavorable influence on the colour development. A certain improvement in the stability of these developers to antioxidation can be attained by addition of hydroxylamine. Nevertheless, colour developers are less stable than the other baths of the appropriate processing sequence.

The application of other water-soluble antioxidants is very restricted, since such compounds may neither react with the oxidized developer substance nor act as developer of the silver halide.

However, these difficulties are very largely overcome by using according to the present invention lipophilic reducing agents dissolved in an oily phase which is emulsified in the processing solution. As reducing agents it is possible to use the mercaptans already mentioned herein, but triarylphosphines are particularly effective. The emulsion is formed by dissolving the triarlyphosphines advantageously in a lipophilic iner solvent, e.g., phosphoric acid tricresyl ester. Such developer emulsions exhibit no undesirable photographic side effects.

EXAMPLE 1

The following mixtures are prepared:

| | | | |
|---|---|---|---|
| A. | sodium carbonate | 60.5 | g |
| | sodium bicarbonate | 16 | g |
| | potassium bromide | 1 | g |
| | bulked with water to | 500 | ml |
| B. | hydroquinone | 15 | g |
| | sodium sulphite (anhydrous) | 7 | g |
| | bulked with water to | 300 | ml |
| | with stirring until all is dissolved | | |
| | polyethylene glycol, mol. wt. 4000, 1% aqueous filtered solution | 10 | g |
| | emulsifier: mixture of acid monophosphate and diphosphate esters of alkylpolyethylene oxides | 10 | g |
| | n-dodecylmercaptan | 45 | g |
| | bulked with water to | 500 | ml |

Mixture B is stirred for 1 minute with an emulsifying device. Solution A is then added and further brief stirring yields a homogeneous, stable emulsion which is suitable as a developer for lith films. The following procedure, for example, can be carried out:

A lith film of conventional composition, which on a polyester support contains a gelatin-silver halide emulsion (4.5 g of gelatin per $m^2$, 8.4 g of silver halide per $m^2$, 31 parts of silver bromide to 69 parts of silver chloride) with an average grain diameter of 0.4 $\mu$m), is imagewise exposed and then agitated to and fro for 4½ minutes at 22°C in the emulsion of the above composition. The film is fixed and finished in the conventional manner. The image corresponds in quality to one that is obtained with the same material using a commercial lith developer. But while the effectiveness of the latter diminishes considerably after standing in the air for a short time, the activity of the developer emulsion according to this Example remains practically unchanged over the course of several days.

EXAMPLE 2

The following mixtures are prepared:

| | | | |
|---|---|---|---|
| A. | hydroquinone | 15 | g |
| | sodium sulphite (anhydrous) | 7 | g |
| | emulsifier as Example 1 | 10 | g |
| | potassium bromide | 1 | g |
| | dodecylmercaptan | 40 | g |
| | polyethylene glycol 1500 | 2 | g |
| | bulked with water to | 500 | ml |
| B. | potassium carbonate (anhydrous) | 70 | g |
| | boric acid | 8 | g |
| | bulked with water to | 500 | ml |

Mixture A is stirred for 1 minute with an emulsifying device, cooled to room temperature, then mixture B is added and a homogeneous emulsion is obtained by stirring gently.

The resulting emulsion corresponds to that of Example 1 in stability. It can be used for developing lith films in the indicated manner. The development time at room temperature is advantageously 3 minutes.

EXAMPLE 3

The following mixtures are prepared:

| | | | |
|---|---|---|---|
| A. | potassium carbonate | 65 | g |
| | sodium sulphite (anhydrous) | 3 | g |
| | hydroxylamino sulphate | 2.5 | g |
| | potassium bromide | 0.7 | g |
| | N-n-butyl-4-sulphobutyl-p phenylenediamine or N-ethyl-N-β-hydroxyethyl-p-phenylenediamine sulphate | 4 | g |
| | bulked with water to | 500 | ml |
| B. | triphenylphosphine | 2 | g |
| | tricresylphosphate | 8 | ml |
| | emulsifier: mixture of acid monophosphate and diphosphate esters of alkylpolyethylene oxides | 2.5 | g |
| | bulked with water to | 500 | ml |

The triphenylphosphine is dissolved in the tricresylphosphate and the solution is emulsified in the water with the addition of the emulsifier using a high-performance impeller. Stirring is performed over the course of about 15 minutes, so that the droplet diameter of the triphenylphosphine solution is not substantially greater than 1 μm.

Solution A is then added to the emulsion and the whole is stirred for a further 5 minutes. The resulting emulsion remains stable without any change for *d es*. It can be used in the following way as chromogenic colour developer:

A material of the following composition is used: to a polyethylene coated paper support there is applied in known manner a red-sensitive silver chloride bromide emulsion which contains a water-soluble non-diffusing cyan coupler, on top of this a green-sensitive silver chloride bromide emulsion which contains a water-soluble, non-diffusing magenta coupler, and on top of this again a blue-sensitive silver chloride bromide iodine emulsion which contains a water-soluble, non-diffusing yellow coupler. The material is imagewise expoxed and then processed as follows, the temperature of the treatment baths being 24°C:

| | |
|---|---|
| 1. colour developing | 5 minutes |
| 2. washing | 5 minutes |
| 3. first fixation | 2 minutes |
| 4. washing | 2 minutes |
| 5. silver bleaching | 2 minutes |

-continued

| | |
|---|---|
| 6. washing | 2 minutes |
| 7. second fixation | 2 minutes |
| 8. washing | 2 minutes |
| 9. drying | 10 minutes |

The processing solutions have the following compositions:

1. Colour developer: emulsion of the composition indicated in the present Example 3. and 7. Fixing bath (pH = 4.5)

| | | |
|---|---|---|
| sodium thiosulphate, cryst. ($6H_2O$) | 80 | g |
| sodium sulphite, anhydrous | 5 | g |
| sodium borate (borax) | 6 | g |
| potassium aluminium sulphate (alum) | 7 | g |
| acetic acid | 4 | g |
| bulked with water to | 1000 | ml |
| 5. Silver bleach (pH = 7.2) | | |
| potassium hexacyanoferrate (III) | 100 | g |
| boric acid | 10 | g |
| sodium borate | 5 | g |
| bulked with water to | 1000 | ml |

A colour image is obtained which has virtually the same appearance as a corresponding image produced with commercial colour developers. The number of images which can be developed with a specific amount of the emulsion is the same regardless of whether all images are developed immediately after each other or whether the processing is extended over several days.

EXAMPLE 4

| | | |
|---|---|---|
| The constituents | | |
| sulphamic acid | 60 | g |
| ascorbic acid | 1 | g |
| potassium iodide | 34 | g |
| tricresylphosphate | 10 | g |
| diazine of the formula (1) | 0.25 | g |
| emulsifier: dialkylphenoxy-poly-(ethyleneoxy)-ethanol with ethoxylation degree 10 to 11 | 0.25 | g |
| bulked with water to | 1000 | ml |

are combined as follows:

The diazine is dissolved in the tricresylphosphate and the solution is emulsified in the aqueous solution of the other constituents with a high-performance device. A stable, white emulsion is obtained.

Instead of the diazine of the formula (1), it is also possible to use as dye bleach catalyst the diazine of the formula (2), and these diazines can be dissolved in dibutyl phthalate or in paraffin oil instead of in tricresylphosphate.

The emulsion can be used as dye bleach agent in the silver dye bleach material in the following way: as material there is used one that contains a green-sensitive silver bromide emulsion with the magenta dye of the formula

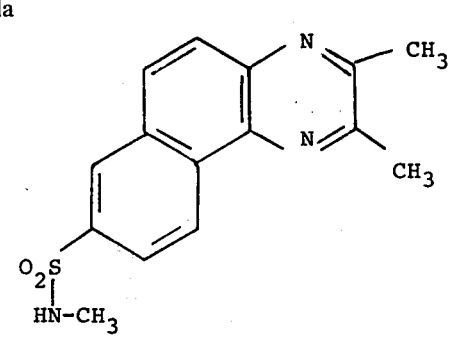

or

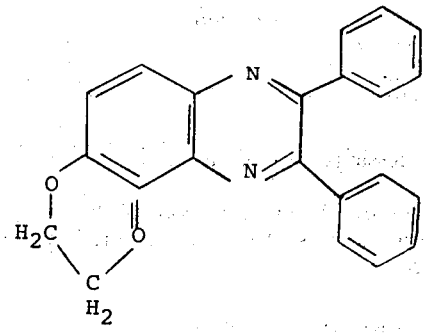

1. 6 minutes developing with a bath which contains per liter of water: 50 g of sodium sulphite, 6 g of hydroquinone, 1 g of potassium bromide, 0.25 g of 1-phenyl-3-pyrazolidone, 10 g of broax and 10 g of sodium metaborate;

2. washing 5 minutes;

3. 6 minutes fixation in a solution of 200 g of cryst. sodium thisulphate and 20 g of potassium metabisulphate in a liter of water 4. washing, 5 minutes;

5. 4 to 8 minutes dye bleaching in the emulsion described at the outset of this Example;

6. washing, 10 minutes;

7. 5 minutes residual silver bleaching with a solution of 60 g of cryst. copper sulphate, 80 g of potassium bromide and 15 ml of 30% hydrochloric acid in a liter of water;

8. washing, 5 minutes;

9. 5 minutes fixation as indicated under (3).

10. washing, 5 minutes;

11. drying.

We claim:

1. Liquid preparation suitable for the processing of photographic silver dye bleach material, which preparation substantially consists of an oil-in-water emulsion which comprises as an acitve substance, capable of exerting its action on the photographic material, a lipophilic dye bleach catalyst more readily soluble in the oily phase than in the aqueous one.

2. Liquid preparation as claimed in claim 1 which contains a dye bleach catalyst of the formula

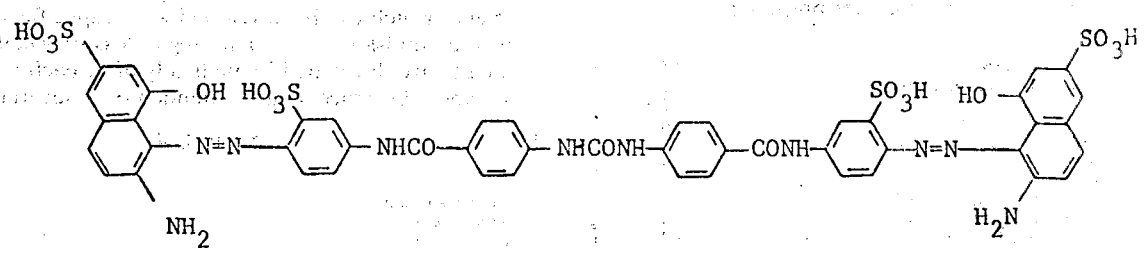

* * * * *

UNITED STATES PATENT OFFICE
CERTIFICATE OF CORRECTION

PATENT NO. : 3,957,516
DATED : May 18, 1976
INVENTOR(S) : Matthias Schellenberg et al.

It is certified that error appears in the above-identified patent and that said Letters Patent are hereby corrected as shown below:

Col. 6, line 56, delete entire formula;
Col. 7 lines1-14, delete entire formula and insert the following formula:

--

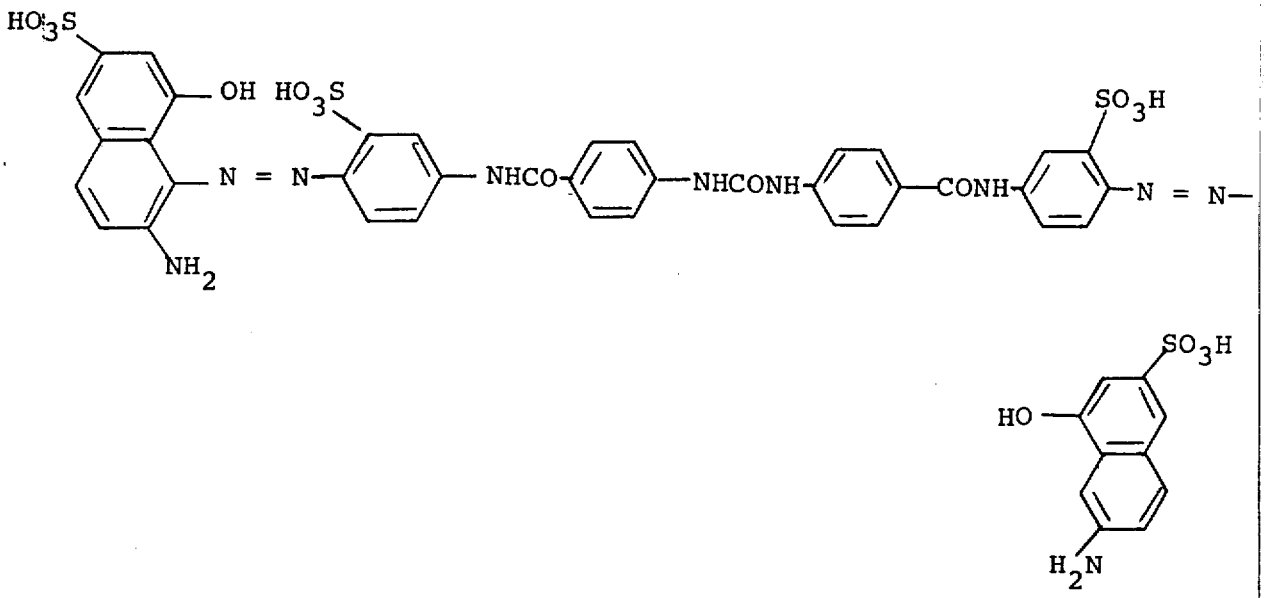

---

UNITED STATES PATENT OFFICE

CERTIFICATE OF CORRECTION

PATENT NO. : 3,957,516

DATED : May 18, 1976

INVENTOR(S) : Matthias Schellenberg et al.

It is certified that error appears in the above-identified patent and that said Letters Patent are hereby corrected as shown below:

Col. 8, line 22, claim 2 after the word "formula"

delete the entire formula and insert the following formula:

--

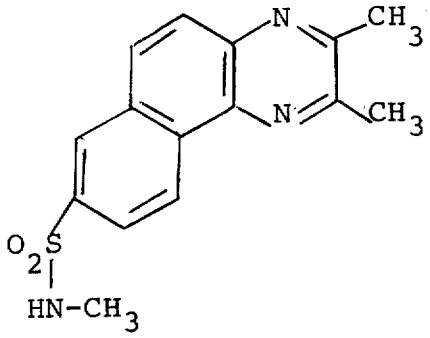

or

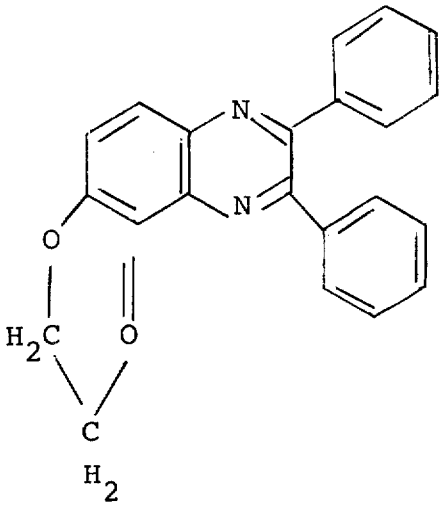

---

Signed and Sealed this

Seventh Day of September 1976

[SEAL]

*Attest:*

RUTH C. MASON
*Attesting Officer*

C. MARSHALL DANN
*Commissioner of Patents and Trademarks*